US006223564B1

(12) United States Patent
Lonati et al.

(10) Patent No.: US 6,223,564 B1
(45) Date of Patent: May 1, 2001

(54) METHOD FOR MANUFACTURING TUBULAR ITEMS, SUCH AS HOSIERY ITEMS OR THE LIKE, WHICH ARE CLOSED AT AN AXIAL END, USING A SINGLE-CYLINDER CIRCULAR MACHINE

(75) Inventors: Francesco Lonati; Ettore Lonati; Tiberio Lonati; Fausto Lonati, all of Brescia (IT)

(73) Assignee: Lonati S.p.A., Monza (IT)

( * ) Notice: Subject to any disclaimer, the term of this patent is extended or adjusted under 35 U.S.C. 154(b) by 0 days.

(21) Appl. No.: 09/570,448

(22) Filed: May 12, 2000

(30) Foreign Application Priority Data

May 14, 1999 (IT) ..... MI99A1068

(51) Int. Cl.[7] ..... D04B 15/18

(52) U.S. Cl. ..... 66/8; 66/58; 66/148; 66/95; 66/107

(58) Field of Search ..... 66/7, 8, 17, 19, 66/20, 21, 31, 40, 215, 178 R, 179, 58, 95, 107, 104

(56) References Cited

U.S. PATENT DOCUMENTS

| | | | | |
|---|---|---|---|---|
| 5,570,591 | * | 11/1996 | Frullini et al. | 66/58 |
| 5,617,744 | * | 4/1997 | Conti | 66/148 |
| 5,727,400 | * | 3/1998 | Lonati et al. | 66/148 |
| 5,761,931 | * | 6/1998 | Lonati et al. | 66/148 |
| 5,816,075 | * | 10/1998 | Lonati et al. | 66/28 |
| 5,855,122 | * | 1/1999 | Lonati et al. | 66/95 |
| 5,907,960 | * | 6/1999 | Lonati et al. | 66/28 |
| 6,044,668 | * | 4/2000 | Conti | 66/148 |

FOREIGN PATENT DOCUMENTS

| | | |
|---|---|---|
| 0 592 376 | 4/1994 | (EP) . |
| 0 803 599 | 10/1997 | (EP) . |
| 0 814 186 | 12/1997 | (EP) . |
| 0 882 826 | 12/1998 | (EP) . |

* cited by examiner

*Primary Examiner*—Danny Worrell
(74) *Attorney, Agent, or Firm*—Guido Modiano; Albert Josif; Daniel O'Byrne

(57) ABSTRACT

A method for producing tubular items, such as hosiery items and the like, which are closed at an axial end, using a single-cylinder circular knitting machine provided with a half-dial which faces, in an upward region, a first half of the needle cylinder and has hooks which can move in a radial direction with respect to the axis of the needle cylinder, each hook being arranged between two contiguous needles of the half of the needle cylinder that it faces. The half-dial can turn over about a diametrical axis of the needle cylinder so that its hooks face the needles of the second half of the needle cylinder. The hooks can move in a radial direction with respect to the axis of the needle cylinder in order to engage portions of loops of knitting formed by the needles of the first half of the needle cylinder before the half-dial turns over and in order to release the portions of loops of knitting to the needles of the second half of the needle cylinder after the half-dial has turned over. After the half-dial has turned over, the loops of knitting formed by the needles of the first half of the needle cylinder and belonging to a row of knitting that follows the one engaged by the hooks are arranged above the needles of the second half of the needle cylinder. The needles of the second half of the needle cylinder are raised to knit in order to pass through the loops of the subsequent row of knitting and knit new loops in, with the loops of the subsequent row of knitting in the subsequent knitting of the item.

13 Claims, 9 Drawing Sheets

6
18a
11a
15
7
5
16
20
8
20a
A
B
A
B
A
4
3
2
4

6
18a
11a
5
15
16
20b
20
8
20a
4
4
4
4
4
4
A
B
A
B
A
3
2

6
18a
11a
7
15
20b
16
8
20a
4
4
4
4
4
4
A
B
A
B
A
3
2

11b
18b
6
5
8
9
10
40
41
42
30
30
30

METHOD FOR MANUFACTURING TUBULAR ITEMS, SUCH AS HOSIERY ITEMS OR THE LIKE, WHICH ARE CLOSED AT AN AXIAL END, USING A SINGLE-CYLINDER CIRCULAR MACHINE

BACKGROUND OF THE INVENTION

The present invention relates to a method for manufacturing tubular knitted items, such as hosiery items or the like, which are closed at an axial end, using a single-cylinder circular machine.

It is known that hosiery items are currently manufactured with circular hosiery knitting machines which form the item generally starting from the upper end of the leg, or top, of the hosiery item, and ending the knitting at the toe, which is left open.

The hosiery items must therefore be subjected to a subsequent darning or looping operation, which closes the toe of the hosiery item in order to form the finished product.

Since the toe closure operation significantly affects the production costs of hosiery items, in recent years methods have been proposed, and machines have been studied, which are meant to manufacture hosiery items with a closed toe, i.e., such as to obtain, at the output of the circular machine that forms them, hosiery items in which the toe is already closed.

One of the proposed methods consists in forming the hosiery item by starting from the toe instead of starting from the top. A method of this kind is performed by means of a single-cylinder knitting machine, which is provided with a half-dial, arranged at the upper end of the needle cylinder and facing, in an upward region, one half of said needle cylinder. Said half-dial is provided with hooks which can be actuated so as to engage the loops of knitting that are knitted by the needles of one half of the needle cylinder and said half-dial can be turned over about a diametrical axis of the needle cylinder in order to face the needles of the other half of the needle cylinder.

According to this method, the half-dial initially faces, in an upward region, a first half of the needle cylinder and, in a first step of knitting, during which the needle cylinder is actuated, with an alternating rotary motion about its axis, with at least one forward movement and at least one return movement, the needles of the first half of the needle cylinder, and the hooks of the overlying half-dial being made to pass in front of a feed of the machine at which a thread is dispensed. During this first step, the hooks are extracted radially, with an end portion, from the half-dial so as to form a support for the thread that is dispensed at that feed and needles of the first half of the needle cylinder are actuated in order to take up the thread, and are alternated with inactive needles, swapping the actuated needles with the inactive needles when the motion of the needle cylinder is reversed.

In a second knitting step, the hooks are retracted into the half-dial, retaining the engaged thread. Then, in a third knitting step, heel knitting is performed with the needles of the first half of the needle cylinder by virtue of an actuation of the needle cylinder with an alternating rotary motion about its own axis.

In a fourth step, the half-dial is turned over, about its diametrical axis, so that its hooks that have retained the thread face the needles of the second half of the needle cylinder.

In a fifth step, the hooks are partially extracted from the half-dial and the needles of the second half on the needle cylinder are also actuated. Meanwhile the needle cylinder is actuated with a continuous rotary motion about its own axis in order to form new loops of knitting with the needles of the second half of the needle cylinder, the loops being knitted in with the thread carried by the hooks, which are then retracted into the half-dial in order to release the previously retained and transferred thread. Finally, the machine is actuated in a conventional manner in order to complete the item, which is thus formed with a closed toe directly in the machine.

Through the years, this method has proved to be susceptible of improvements, such as for example the improvement disclosed in U.S. Pat. No. 5,907,960, in which, during the execution of the first step of the above described method, in the forward and/or return motion of the needle cylinder, the first needle of the second half of the needle cylinder also is made to pass in front of the feed (which dispenses the thread to the needles of the first half of the needle cylinder) and is actuated so as to engage the thread, allowing the thread to be engaged by both of the end hooks of the half-dial. By virtue of this improvement, the hosiery item is perfectly closed also at both ends of the initial row of knitting, which constitutes the toe closure row.

Generally, the above described methods are performed by using a half-dial which is provided with a plurality of radial slots, each arranged between two contiguous axial slots of the curved surface of the needle cylinder; a needle slides inside each one of said slots. A hook is arranged inside each radial slot of the half-dial and is constituted by a laminar body which, at its end directed away from the axis of the needle cylinder, is uncinate and open upward during the first step of knitting, i.e., when the hooks face from above the needles of the first half of the needle cylinder. Said uncinate end has a lug which faces the open end of the uncinate body so as to partially close it. Said lug is meant to support the portions of the loops of knitting that are engaged by the hooks when the half-dial is turned over about the diametrical axis in order to make the hooks face the needles of the second half of the needle cylinder.

An auxiliary hook is furthermore arranged inside each radial slot of the half-dial, to the side of each hook; the end of said auxiliary hook that lies opposite with respect to the axis of the needle cylinder is also uncinate but is orientated in the opposite direction with respect to the uncinate end of the adjacent hook.

Furthermore, in the hook and/or the auxiliary hook the uncinate end portions can flex elastically toward each other as a consequence of the movement of the hooks toward the axis of the needle cylinder, partially retracting into the radial slots of the half-dial so that the uncinate end of the auxiliary hook laterally overlaps the uncinate end of the hook, closing it in order to firmly retain the loops of knitting inside the two uncinate ends of the hook and of the auxiliary hook, respectively, during the overturning of the half-dial about the diametrical axis.

In some cases the auxiliary hook, instead of being physically separate from the hook, is constituted by an elastic lamina which is rigidly fixed to a lateral face of said hook and has an uncinate end which lies opposite the uncinate end of the hook.

The mutual approach of the uncinate ends of the hook and of the auxiliary hook is achieved by providing bends in the hook and/or the auxiliary hook; during the retraction of the hook and of the auxiliary hook into the radial slots of the half-dial, said bends interfere with the side walls of said radial slots, elastically deforming the ends of said elements, causing them to move mutually closer and accordingly causing, by elastic reaction, their mutual spacing as soon as they are partially extracted, starting from their uncinate end, from the radial slots of the half-dial.

The above described conventional methods allow to produce tubular items, particularly hosiery items, which are closed at the toe directly on the machine used to manufacture them, and yield good results in terms of quality only if an elastic thread is used to form the first row of knitting, i.e., the row that in practice constitutes the closure of the toe.

Using an elastic thread, however, provides an elasticized closure of the toe of the hosiery item which is not always appreciated with respect to the conventional closure of the toe performed, by looping or darning, with a practically inextensible thread.

SUMMARY OF THE INVENTION

The aim of the present invention is to provide a method which allows to produce tubular items, such as hosiery items or the like, which are closed at one axial end by using a single-cylinder circular knitting machine and with a closure which is not necessarily elasticized.

Within the scope of this aim, an object of the invention is to provide a method which allows to obtain closed-toe hosiery items directly on a single-cylinder circular knitting machine with a quality which can be compared to the quality obtainable with the conventional looping operation.

This and other objects and others which will become better apparent hereinafter are achieved by a method for producing tubular items, such as hosiery items or the like, which are closed at an axial end, using a single-cylinder circular knitting machine provided with a half-dial which faces, in an upward region, a first half of the needle cylinder and has hooks which can move in a radial direction with respect to the axis of the needle cylinder, each hook being arranged between two contiguous needles of said first half of the needle cylinder, said half-dial being able to turn over about a diametrical axis of the needle cylinder so that its hooks face the needles of the second half of the needle cylinder, said hooks being movable in a radial direction with respect to the axis of the needle cylinder in order to engage portions of loops of knitting formed by the needles of said first half of the needle cylinder, before said half-dial turns over, and in order to release said portions of loops of knitting to the needles of said second half of the needle cylinder after the half-dial has turned over, characterized in that after said half-dial has turned over, the loops of knitting, formed by said needles of the first half of the needle cylinder and belonging to a row of knitting that follows the one engaged by said hooks, are arranged above the needles of the second half of the needle cylinder, and in that the needles of said second half of the needle cylinder are raised for knitting so as to pass through the loops of said subsequent row of knitting, and knit new loops in with the loops of said subsequent row of knitting in the subsequent knitting of the item.

The method according to the invention is preferably performed by means of a single-cylinder circular knitting machine for producing tubular items, such as hosiery items or the like, which are closed at an axial end, comprising a needle cylinder which can be turned about its own axis and has, on its curved surface, a plurality of axial slots, each of which accommodates a needle, and a half-dial which faces the needle cylinder in an upward region and has a plurality of radial slots, each of which is arranged between two axial slots of the needle cylinder; each one of said radial slots accommodating a hook the end whereof that is directed away from the axis of the needle cylinder is uncinate, and an auxiliary hook one end whereof, which is directed away from the axis of the needle cylinder, is uncinate in the opposite direction with respect to the uncinate portion of said hook and can move in order to open or close said uncinate end of the hook; said half-dial being able to turn over on command about a diametrical axis of the needle cylinder so that said hooks face, with their uncinate end directed upward, the needles of a first half of the needle cylinder or, with their uncinate end directed downward, the needles of the other half, or second half, of the needle cylinder, retaining loops of knitting in said uncinate end, characterized in that each one of said hooks has a beak which faces said uncinate end of the hook; said beak, when said half-dial faces the needles of said second half of the needle cylinder, being arranged below said uncinate end of the hook and being able to engage a loop of knitting which belongs to a subsequent row of knitting with respect to the loop of knitting engaged by said uncinate end of the hook.

BRIEF DESCRIPTION OF THE DRAWINGS

Further characteristics and advantages of the invention will become better apparent from the description of a preferred but not exclusive embodiment of the method, according to the invention, and of the machine for performing the method, illustrated only by way of non-limitative example in the accompanying drawings, wherein.

DESCRIPTION OF THE PREFERRED EMBODIMENTS

Figure 1:
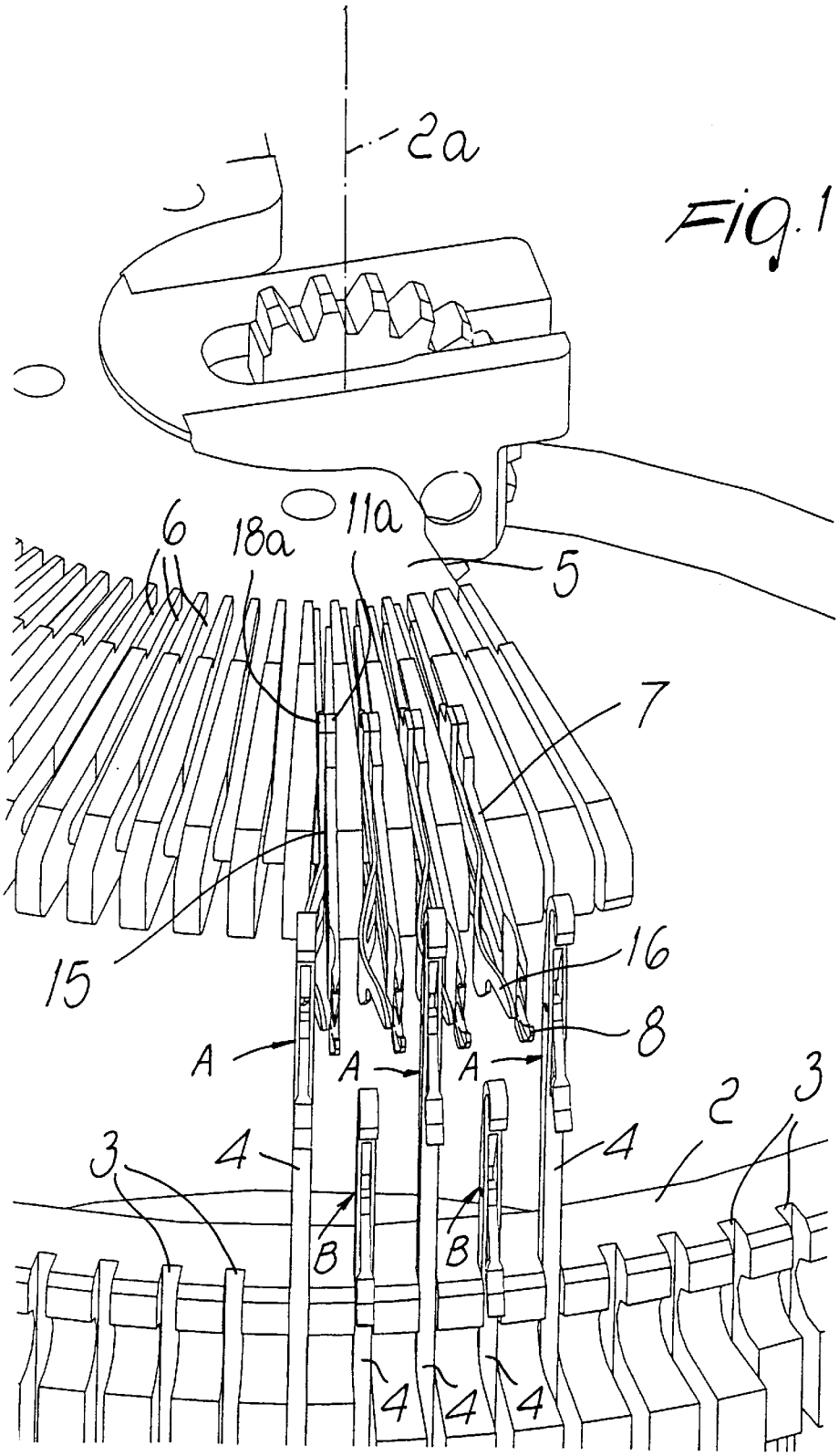
FIGS. 1 to 7 are schematic perspective views showing the various steps of the method according to the invention, performed with a single-cylinder knitting machine in which the half-dial can be turned over.

With reference to the above figures, the method according to the invention can be performed with a single-cylinder circular knitting machine which comprises a needle cylinder 2 which can be rotationally actuated about its own vertical axis 2*a* and has, on its curved surface, a plurality of axial slots 3, each of which internally slidingly accommodates a needle 4, 30 which can be actuated so to engage the thread at one or more feeds of the machine in order to form loops of knitting, in a per se known manner, like currently commercially available single-cylinder circular knitting machines. Above the needle cylinder 2 there is a half-dial 5 which is shaped like one half of an annulus whose axis coincides with the axis 2*a* of the needle cylinder 2.

In the half-dial 5 there is a plurality of radial slots 6, and each radial slot 6 internally accommodates a hook 7.

The hook 7 comprises an elongated and flat laminar body which has an uncinate portion 8 at one of its axial ends, more specifically the axial end that is meant to be directed toward the outside of the needle cylinder 2, i.e., away from the axis 2*a* of the needle cylinder 2.

At said axial end, the hook 7 may also have a lug 9 which faces the open end of the uncinate portion 8 so as to partially close said uncinate portion 8.

On the bridge of the lug 9 there is also a beak 10 which protrudes on the side of the lug 9 that lies opposite the side directed toward the uncinate portion 8.

Alternatively, the lug 9 may also be omitted. In this case, the beak 10 protrudes in the same position, i.e., it faces the open end of the uncinate portion 8 of the hook 7. The body of the hook 7 is furthermore provided with one or more heels 11*a* and 11*b* which protrude respectively upward and downward from the corresponding radial slot 6 of the half-dial 5 and can engage cams which face the half-dial and form paths which can be engaged by the heels 11*a* and 11*b* so as to produce, during the actuation of the needle cylinder 2 and of the half-dial 5 with a rotary motion about the axis 2*a* of said needle cylinder with respect to said cams, the controlled movement of the hooks 7 toward the axis 2*a* of the needle cylinder 2 or in the opposite direction, as will become apparent hereinafter.

The body of the hook 7 can furthermore have, starting from its axial end that is directed toward the axis 2*a* of the needle cylinder 2, a longitudinal slot 12 so as to engage the two opposite faces of the half-dial 5, for example as disclosed in U.S. patent application Ser. No. 09/419,624.

Inside each radial slot 6, to the side of each hook 7, there is also an auxiliary hook 15 which also has an elongated and flat laminar body. The end of the auxiliary hook 15 that is directed toward the outside of the needle cylinder, i.e., away from the axis 2*a* of the needle cylinder 2, also has an uncinate portion 16, but said portion is orientated in the opposite direction with respect to the uncinate portion 8 of the hook 7.

In the auxiliary hook 15, at least the portion that lies proximate to the uncinate end 16 can flex elastically toward or away from the hook 7.

More particularly, the auxiliary hook 15 has, along its extension, proximate to the uncinate end 16, a bend which causes the uncinate end 16 to move away from the side of the corresponding hook 7 in order to allow a needle of the needle cylinder 2 to pass between the hook 7 and the auxiliary hook 15. The auxiliary hook 15, as a consequence of its sliding along the slot 6 toward the axis 2*a* of the needle cylinder 2, interferes, at said bend, with a side of the radial slot 6 and approaches, with the uncinate end 16, the uncinate end 8 of the contiguous hook 7. In the movement of the auxiliary hook 15 in the opposite direction, i.e., when it is partially extracted, toward the outside of the needle cylinder, from the corresponding axial slot 6, by elastic reaction, the uncinate end 16 moves away from the uncinate end 8 of the contiguous hook 7.

The uncinate end 8 of the hook 7 has, on its side that is directed toward the auxiliary hook 15 arranged in the same radial slot 6 of the half-dial, a recess 13 in order to accommodate the tip of the uncinate end 16 of the auxiliary hook 15 when it is closest to the uncinate end 8, as will become apparent hereinafter.

It should be noted that on the side of the hook 7, proximate to its uncinate end 8, on the side directed toward the auxiliary hook 15, there is preferably a recess 14 in order to facilitate the passage of the needle 4, 30, as will become apparent hereinafter.

The auxiliary hook 15 also has, like the hook 7, heels 18*a* and 18*b* which protrude respectively upward and downward from the half-dial 5 in order to engage suitable actuation cams which face the half-dial. The auxiliary hook 15 also may have, starting from its axial end that is directed toward the axis 2*a* of the needle cylinder 2, a longitudinal slot so that its body engages the two opposite faces of the half-dial, as disclosed in U.S. patent application Ser. No. 09/419,624.

It should be noted that the body of the hook 7 and of the auxiliary hook may not have the longitudinal slot and may slidingly engage, in a per se known manner, in the radial slots of the half-dial, for example as disclosed in Italian Patent Application No. M198A000451 by the same Applicant.

Alternatively, the auxiliary hook 15, instead of being physically separate from the hook 7, may simply be constituted by an elastic lamina which is fixed to one side of the hook and is provided with an uncinate axial end which can move elastically toward or away from the uncinate end 8 of the hook 7 in order to close or open it, as disclosed in U.S. Pat. No. 5,855,122.

The machine used to perform the method according to the invention can be a machine similar to the one disclosed in U.S. Pat. No. 5,866,075 provided with a dial or half-dial of the type disclosed in U.S. patent application Ser. No. 09/419,624 but with hooks provided with a beak 10, as shown in FIGS. 8, 9, 10 and 11.

The method according to the invention consists in producing a tubular item, particularly a hosiery item, starting from its end that must be closed on the machine.

The method according to the invention substantially consists in retaining, by means of the hooks 7, portions of loops of the first row of knitting 40 that is knitted by the needles 4 of a first half of the needle cylinder, and in knitting, by means of the same needles 4 of the first half of the needle cylinder 2, a subsequent series of rows of knitting. Then, after turning over the half-dial 5 about its diametrical axis, retaining the portions of the loops of knitting of the first row of knitting 40 formed by the needles 4 of the first half of the needle cylinder, the hooks 7 are arranged so as to face the needles 30 of the second half of the needle cylinder 2, arranging the loops of knitting formed by the needles 4 of the first half of the needle cylinder 2 and belonging to a row of knitting that is subsequent to the one engaged by the hooks 7 above the needles 30 of the second half of the needle cylinder 2 which are raised to knit, so as to pass through the loops of said subsequent row of knitting and knit in the loops of a new row of knitting with the loops of knitting of said subsequent row of knitting in the subsequent knitting of the item.

More particularly, the method according to the invention comprises a first step, during which the needle cylinder 2 is actuated with an alternating rotary motion about its own axis with at least one forward movement and at least one return movement, so as to move the needles 4 of the first half of the needle cylinder, above which the half-dial 5 is arranged, and the hooks 7 of said half-dial 5 so that they pass in front of a feed or drop of the machine at which a thread is fed to the needles 4.

In this first step, the hooks 7 of the half-dial 5 are extracted from the half-dial with their uncinate end 8 directed upward, as shown in FIG. 1, so as to form a support for the thread 20 that is dispensed at said feed, and the needles 4 of the first half of the needle cylinder are actuated in order to engage the thread 20 fed at said feed. It should be noted that during this first step the auxiliary hooks 15 are shifted, with respect to the hooks 7, toward the axis 2*a* of the needle cylinder 2 so that their uncinate end 16 is spaced both laterally and toward the axis 2*a* of the needle cylinder 2 with respect to the uncinate end 8, leaving said uncinate end 8 of the hook 7 free to receive the thread 20 that is dispensed at the feed being considered. The needles 4 that engage the thread 20 are alternated with needles which are kept inactive and the actuated needles are swapped with the inactive needles when the motion of the needle cylinder 2 is reversed.

Figure 2:
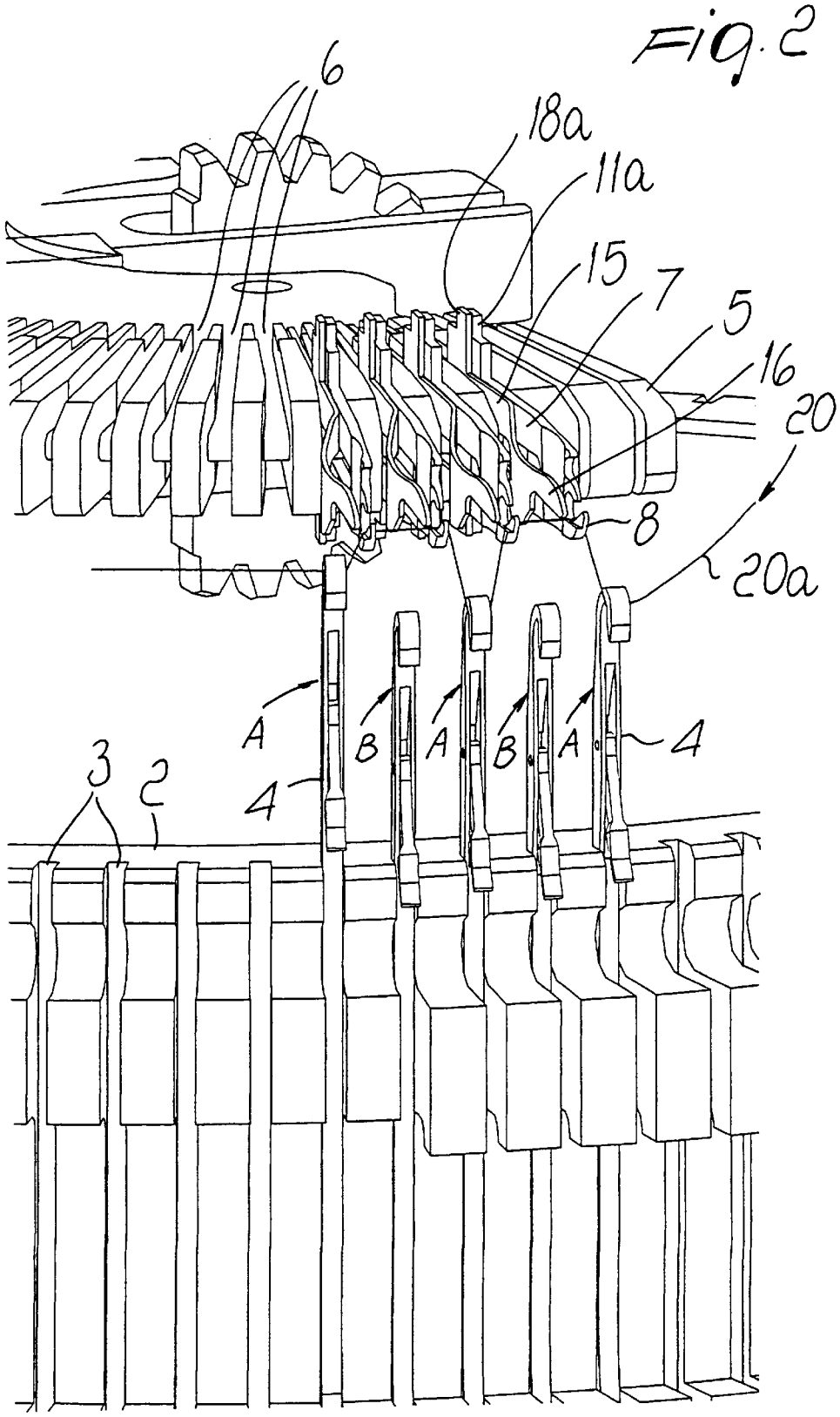

More particularly, as shown in FIG. 2, for example during the forward motion of the needle cylinder, the odd needles of the first half of the needle cylinder 2 located under the half-dial 5, i.e., the first needle, the third needle, the fifth needle and so forth, designated by the arrow A in FIG. 2, are raised to knit, while during said forward motion the even needles B, i.e., the second needle, the fourth needle, the sixth needle and so forth, are kept inactive, i.e., they are not actuated.

Figure 3:
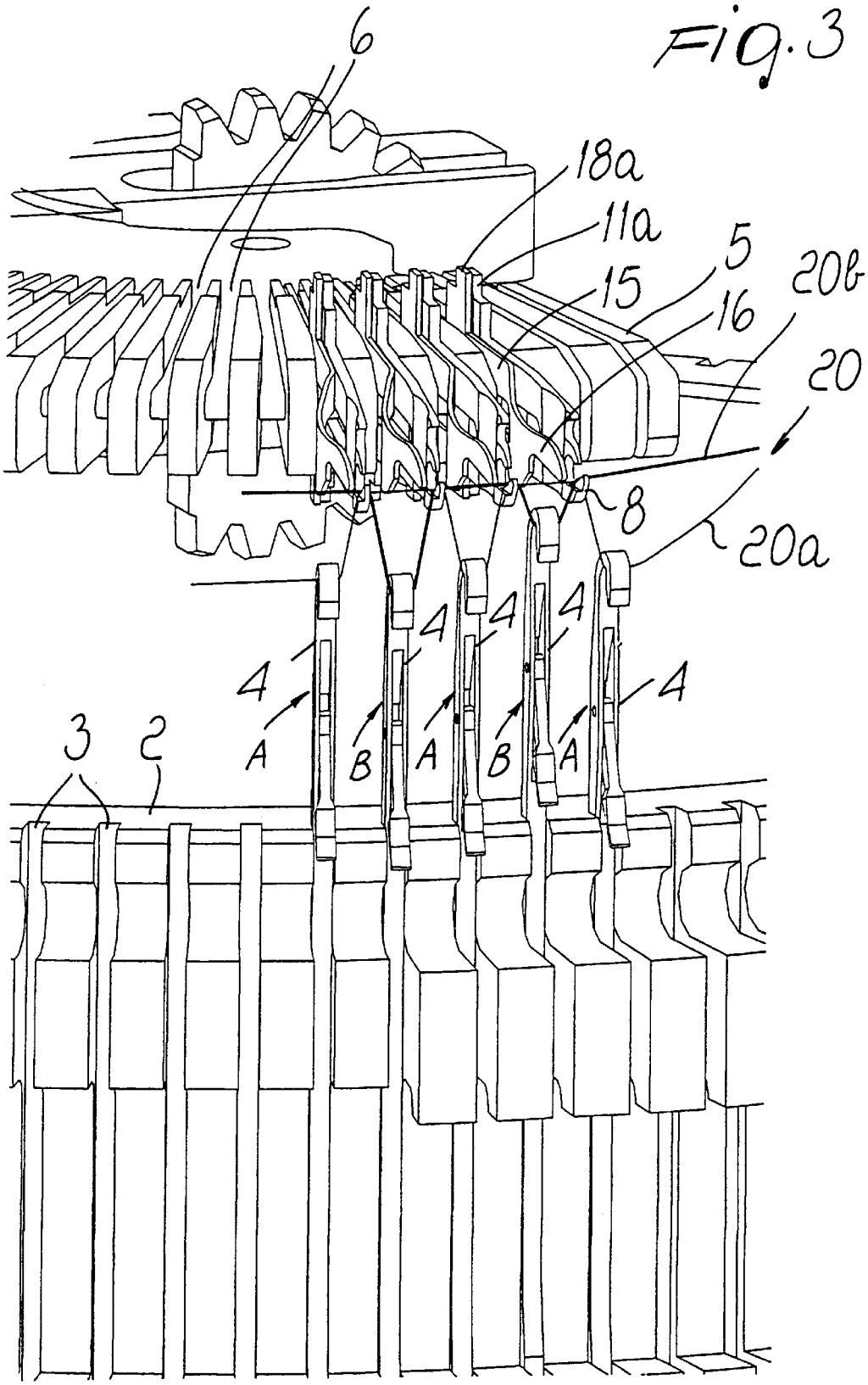

Instead, when the motion of the needle cylinder 2 is reversed, the odd needles A are kept inactive and the even needles B are actuated. In this manner, two threads are arranged on the uncinate end 8 of the hooks 7, and said two threads are engaged respectively by the odd needles A and by the even needles B, as shown in FIG. 3. Actually, said two threads are two portions of a same thread 20 delivered at the feed, but for the sake of clarity said two thread portions have been drawn in different manners and have been designated by the reference numerals 20*a* and 20*b* in FIGS. 2, 3 and 4.

Preferably, the thread 20 is constituted by an elastic thread.

Owing to the fact that there is a needle 4 for each hook 7 of the half-dial 5, the thread engaged by the odd needles A, during the forward motion of the needle cylinder 2, rests on two hooks 7 arranged between two contiguous odd needles A, while during the return motion the thread engaged by the needles B rests on the two hooks 7 arranged between two contiguous even needles B.

In order to allow the thread 20 to be also engaged by the first or last hook 7 supported by the half-dial 5, during this first step of the method, during the forward and/or return motion of the needle cylinder 2, the needle cylinder 2 is actuated so that it also causes the first needle of the second half of the needle cylinder 2, i.e., the needle of the second half of the needle cylinder that lies closest to the initial hook of the half-dial 5, to pass in front of the feed that supplies the thread 20, and said needle is also actuated so as to engage the thread 20, as disclosed in U.S. Pat. No. 5,907,960.

By virtue of this fact, the thread 20 fed at the feed being considered during this first step is also deposited onto the initial hook 7 of the half-dial 5 and is thus retained by it during the subsequent step.

Preferably, the needle cylinder 2 is actuated so that it also causes the last needle of the second half of the needle cylinder 2 to pass in front of the feed being considered, which supplies the thread 20; said needle also is actuated in order to engage the thread at the feed being considered, in order to achieve safer closure at the longitudinal ends of the portion of the row of knitting 40 that is knitted by the needles during this first step and constitutes the row for closing the toe of the item.

Figure 4:
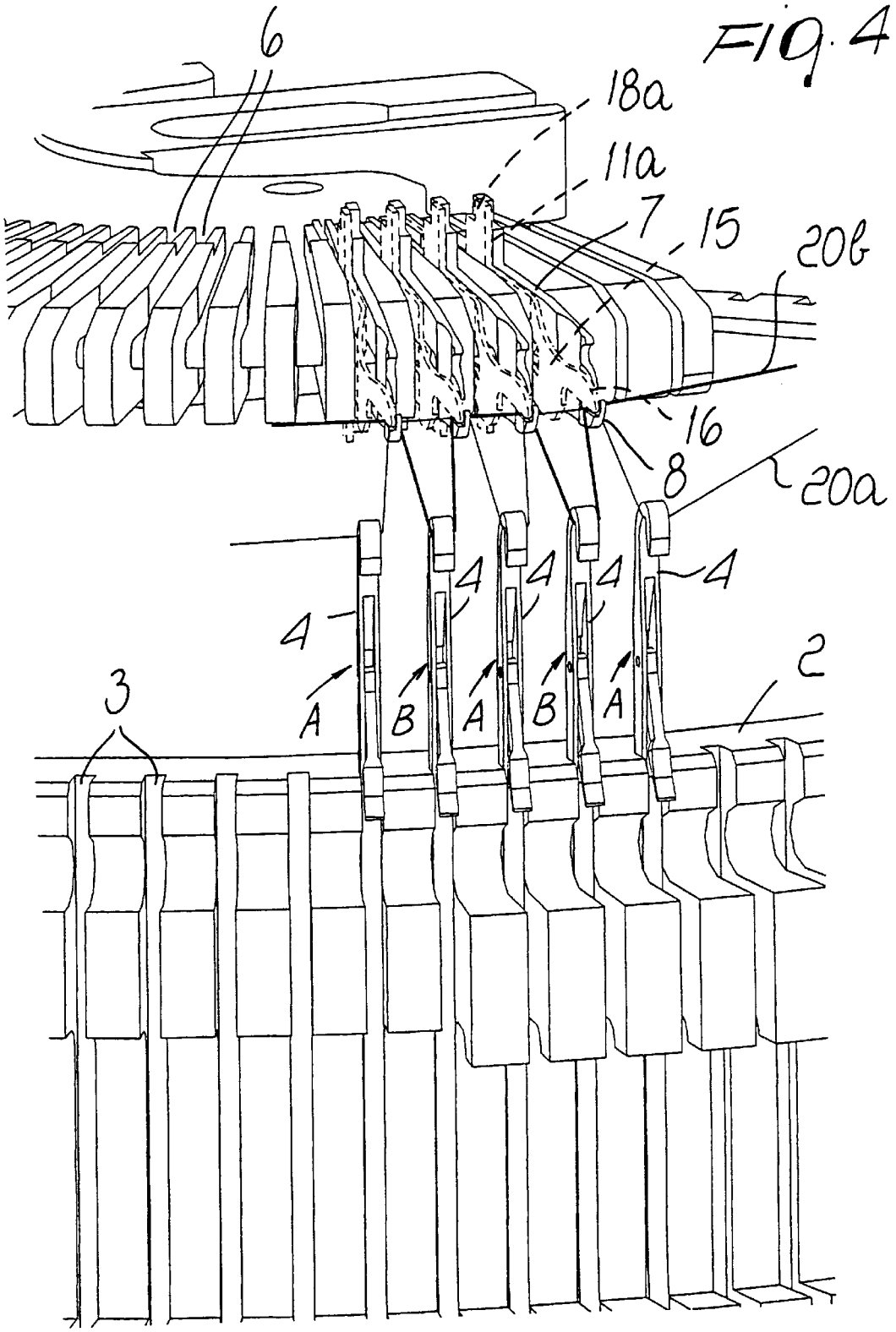

The method then comprises a second step, during which the hooks 7 are retracted into the half-dial 5 together with the auxiliary hooks 15, which are however retracted to a lesser extent, so that their uncinate end 16 rests against the uncinate end 8 of the corresponding hook 7, closing it. In this manner, the thread 20 of the first row of knitting 40 is retained by the uncinate end 8 of the hooks 7, as shown in FIG. 4. If the auxiliary hooks are fixed to one side of the corresponding hooks 7, their retraction toward the axis of the needle cylinder causes the closure of the uncinate end 8 of the hooks 7.

Figure 5:
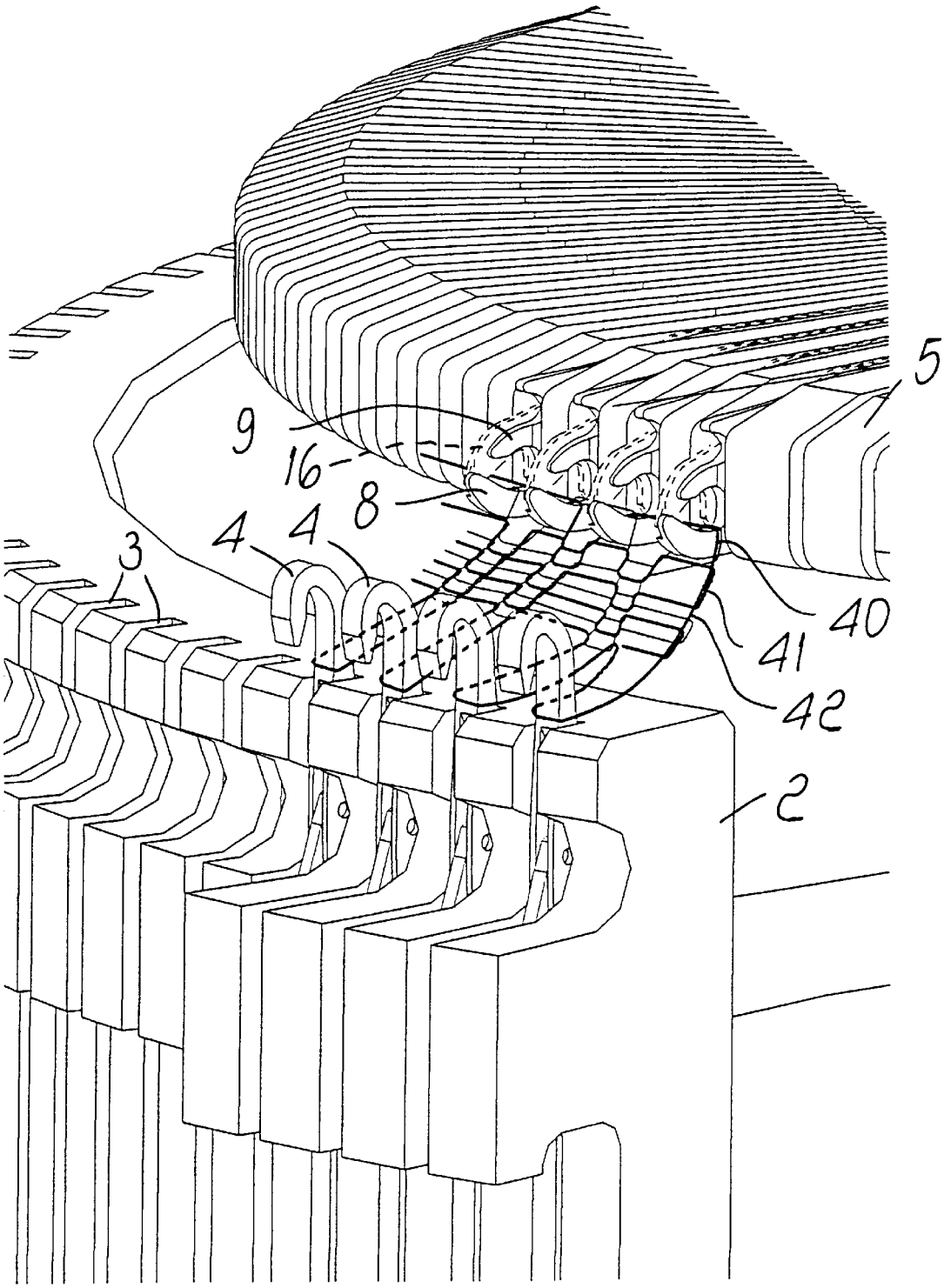

A third step is then performed, during which the machine is actuated so as to produce heel knitting, in a per se known manner, with the needles 4 of the first half of the needle cylinder 2 that have engaged the thread 20, i.e., the needles arranged in the half of the needle cylinder above which the half-dial 5 is arranged, as shown in FIG. 5.

Preferably, the rows of knitting 41 and 42 that follow the first one are formed with a thread which is substantially inextensible or in any case is not as extensible as the thread 20 used for the first row of knitting 40.

Figure 6:
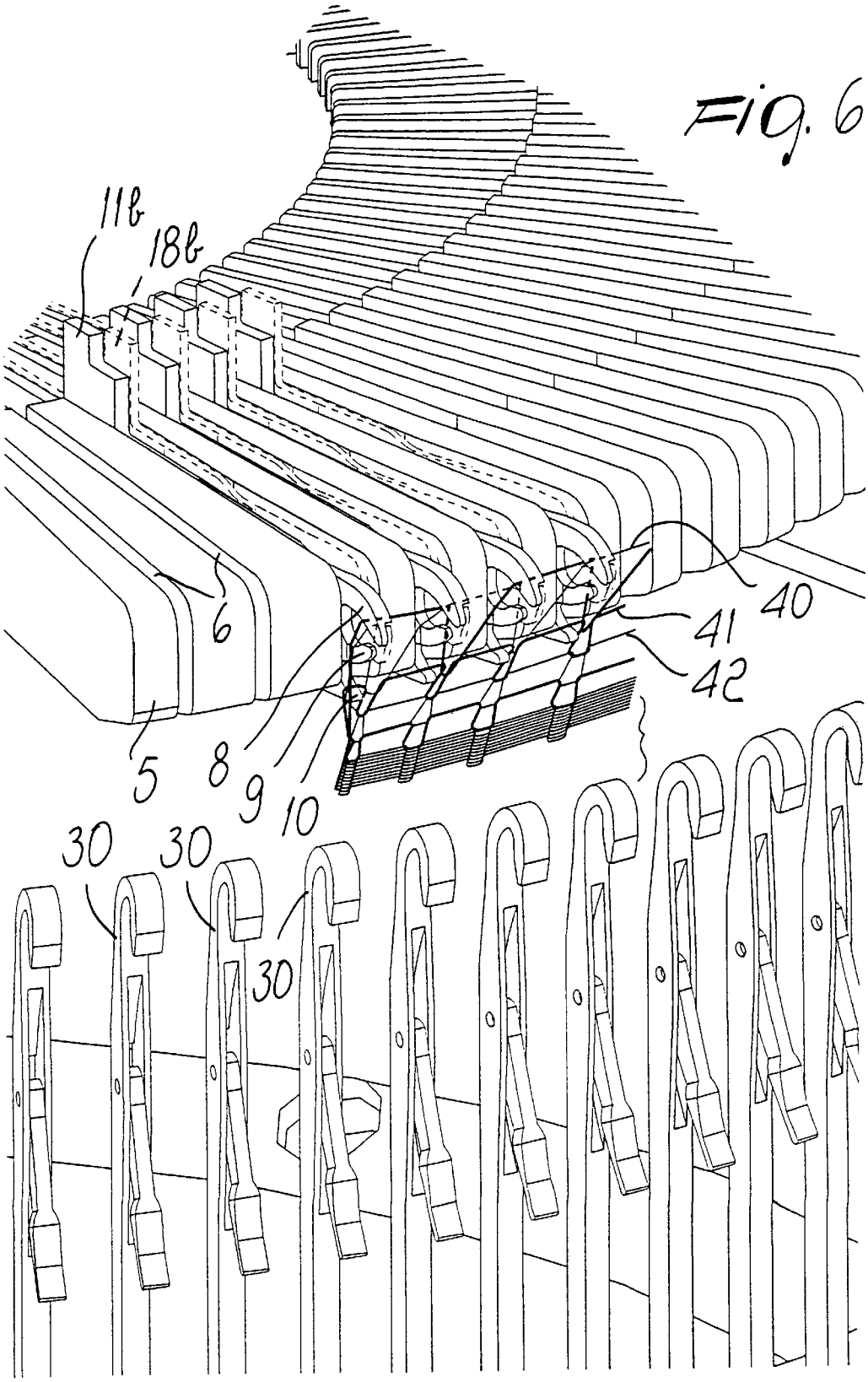
Figure 7:
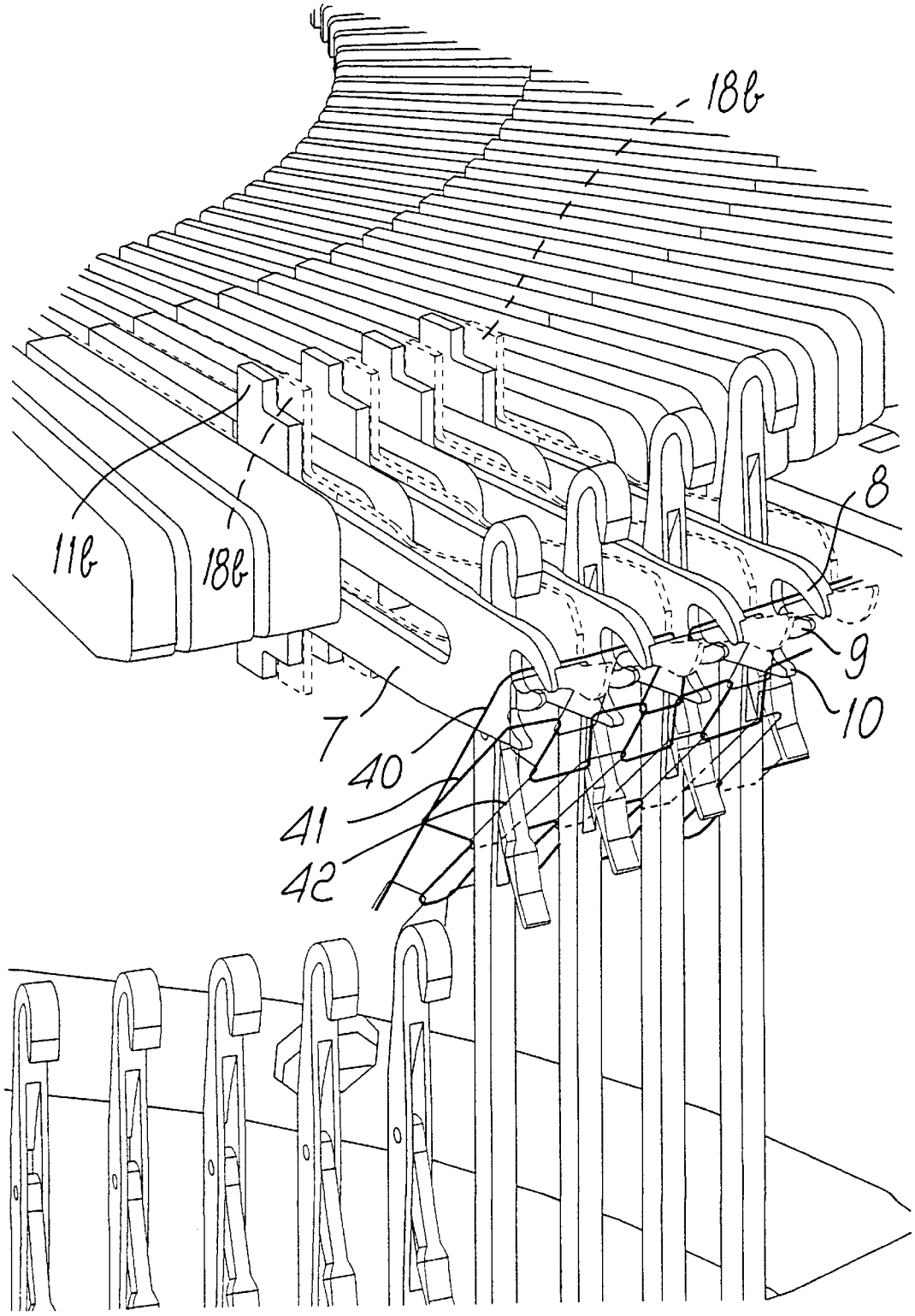
Figure 8:
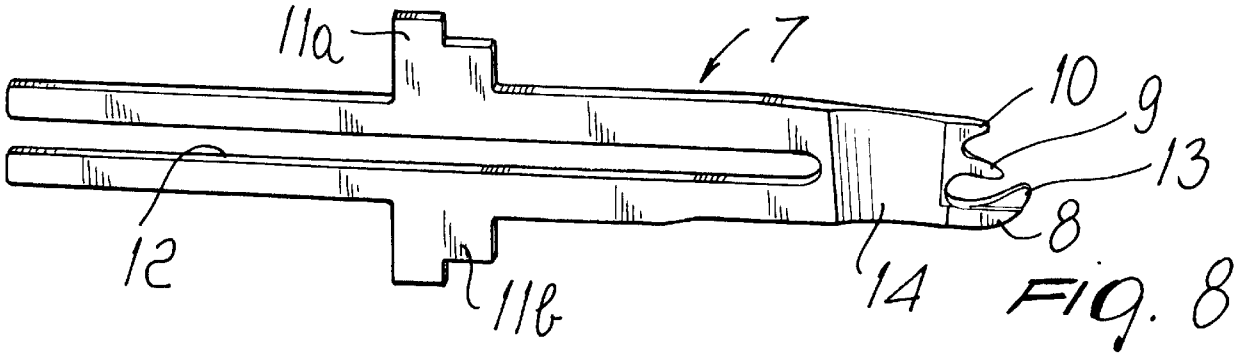
FIG. 8 is a perspective view of a hook which can be used to perform the method according to the invention.
Figure 9:
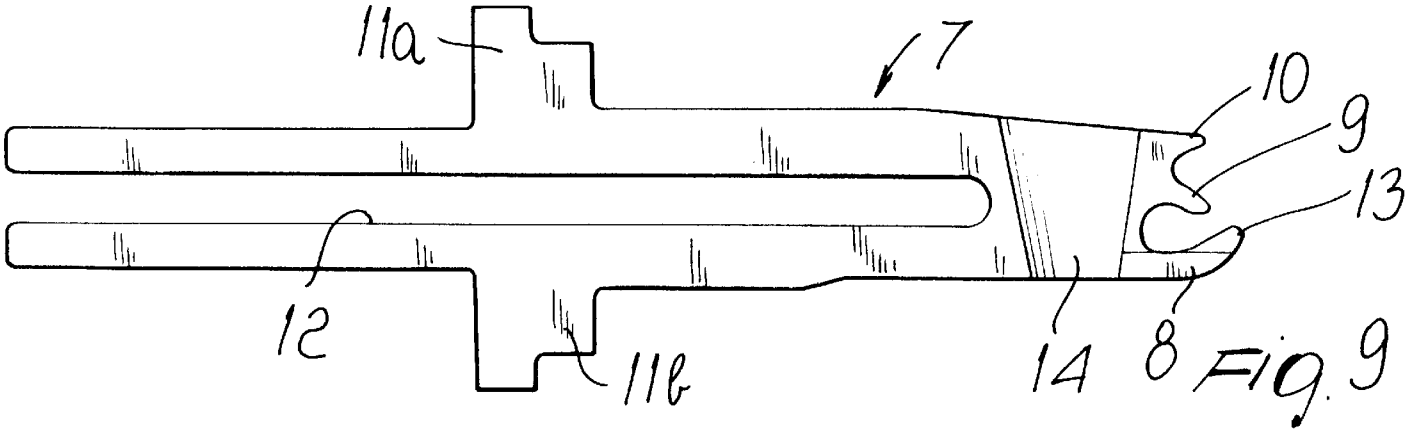
FIG. 9 is an enlarged-scale lateral elevation view of the hook of FIG. 8.
Figure 10:
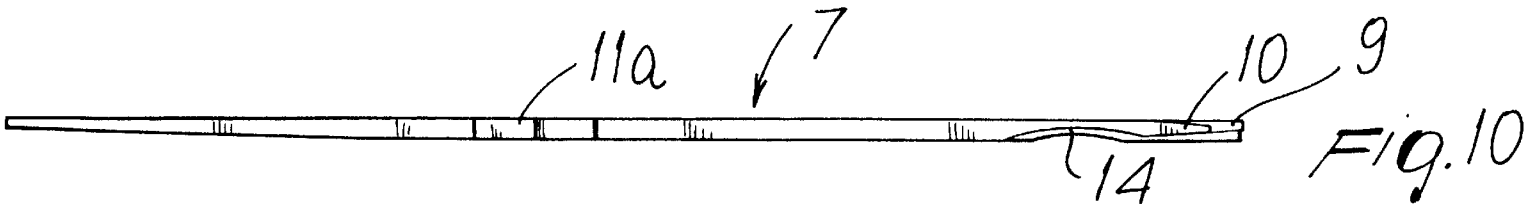
FIG. 10 is a top plan view of the hook of FIGS. 8 and 9.

In a fourth step of the method according to the invention, the half-dial 5 is turned over about the diametrical axis, so that its hooks 7, which retained the thread 20 of the first row of knitting 40 fed in the first step of the method, face the needles 30 of the second half of the needle cylinder 2, as shown in FIG. 6.

During overturning, the portions of loops of the first row of knitting 40 knitted by the needles of the first half of the needle cylinder are firmly retained in the uncinate end 8 of the hooks 7, which is closed by the uncinate end 16 of the auxiliary hooks 15.

Due to the overturning of the half-dial 5 about the diametrical axis, the portions of loops of the first row of knitting 40 pass from the uncinate end 8 onto the uncinate end 16 of the auxiliary hooks 15 or of the lug 9, if provided, and are supported thereby when the overturning of the half-dial 5 is completed.

By turning the half-dial 5 over about the diametrical axis, the hooks 7 are arranged so that their downward-facing uncinate end 8 faces the needles 30 of the second half of the needle cylinder 2.

The hooks 7 and the auxiliary hooks 15 are then partially extracted from the half-dial 5 in the opposite direction with respect to the axis 2*a* of the needle cylinder 2, so that the uncinate end 16 of the auxiliary hooks 15 moves away from the uncinate end 8 of the hooks 7, freeing it and leaving, between the hook 7 and the contiguous auxiliary hook 15, a space which is sufficient to allow the passage of a needle.

The movement of the hooks 7 toward the outside of the needle cylinder 2 moves the beak 10, which is located below the uncinate portion 8 of the hook 7, so that it engages the loops of knitting that belong to a row of knitting that is subsequent to the first row of knitting 40 engaged by the uncinate end 8 of the hooks 7, or by the lug 9 if provided, or by the uncinate end 16 of the auxiliary hooks 15. As a consequence of this fact, the loops that belong to a subsequent row of knitting, preferably the second row of knitting 41 or the third row of knitting 42 starting from the first row 40 supported by the hooks 7 or by the auxiliary hooks 15, are arranged above the needles 30 of the second half of the needle cylinder 2 in a position in which they can be crossed by said needles 30.

The needle cylinder 2 is then actuated with a continuous rotary motion about its own axis 2*a* in order to form a row of knitting by means of the needles 4 of the first half of the needle cylinder 2 as a continuation of the previously formed rows of knitting and so that the needles 30 of the second half of the needle cylinder 2 form a row of loops of knitting which are knitted in with the loops of knitting that belong to said subsequent row 41 or 42. It should be noted that in order to form the new row of knitting, the needles 30 that belong to the second half of the needle cylinder are raised to knit, passing through the loops of knitting that belong to the row 41 or 42 that is subsequent to the one engaged by the uncinate end 8 of the hooks 7, passing between the hook 7 and the auxiliary hook 15. Said subsequent row of knitting, which is crossed by the needles 30 of the second half of the needle cylinder 2, can be constituted by the same row of knitting 41 that is engaged by the beak 10, or by the immediately subsequent row 42, depending on the length of the loops of knitting.

Figure 11:
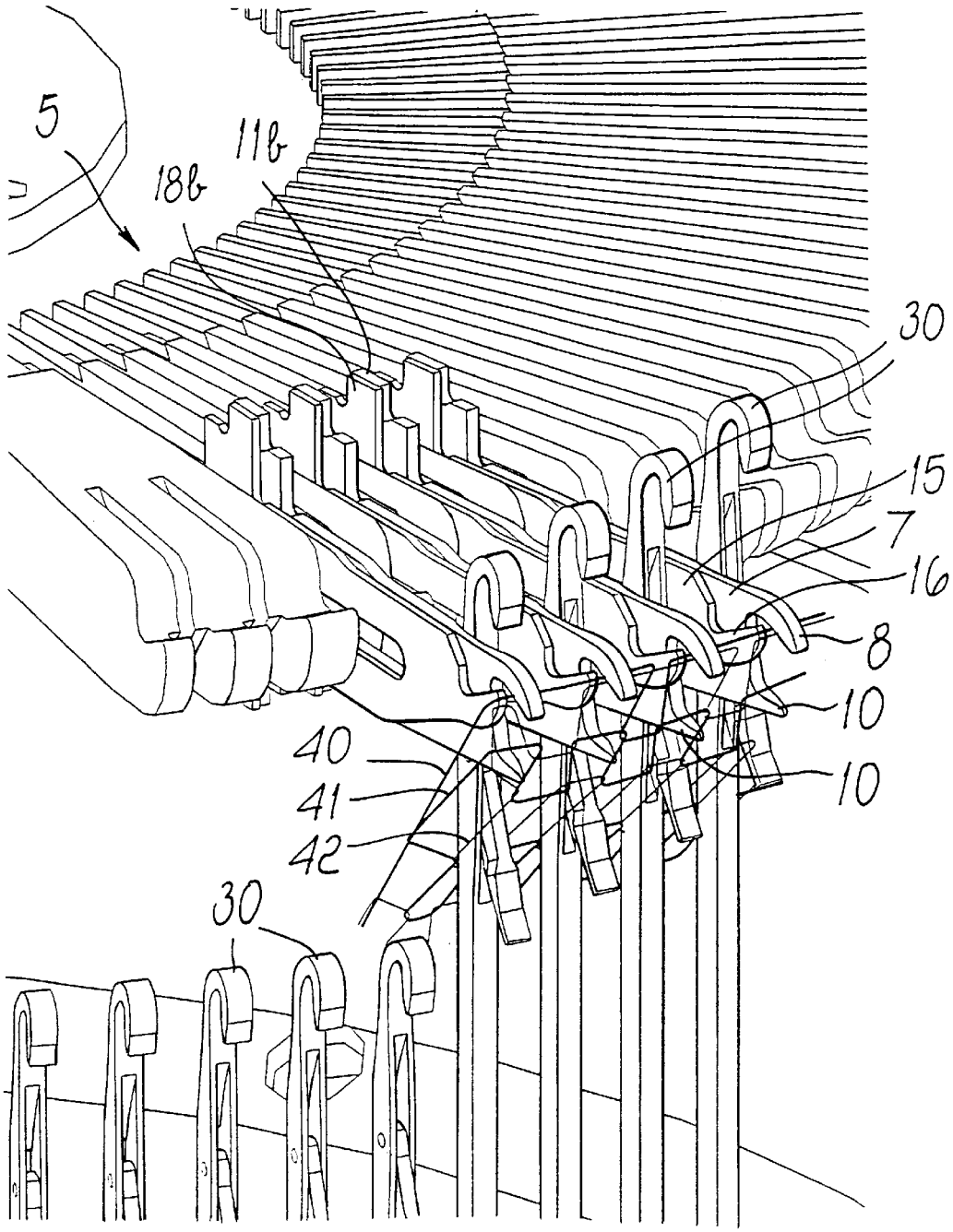
FIG. 11 is a view, similar to FIGS. 1 to 7, illustrating a further embodiment of the method according to the invention.

It should be noted that in the fifth step the needles 30 of the second half of the needle cylinder 2 can form new loops of knitting which are knitted in with the loops of knitting of the subsequent row also by passing laterally outside a hook 7 and the corresponding auxiliary hook 15, passing in any case through the loops of knitting that belong to the row 41 or 42 that follows the first row 40, arranged beforehand by the hooks 7 above the needles 30 of the second half of the needle cylinder 2, as shown in FIG. 11.

In this case, since it is not necessary to make the needle 30 pass between a hook 7 and the auxiliary hook 15, the auxiliary hook 15 can have a substantially flat shape, i.e., without lateral bends.

Optionally, it is possible to provide, on the side of the hook 7 that is directed toward the needle 30, a recess which is similar to the recess 14 in order to facilitate the passage of the needle 30 to the side of the hook 7.

Although the hooks and auxiliary hooks shown in FIG. 11 have a slightly different shape with respect to the one shown in the preceding figures, the same reference numerals used in the preceding figures have been retained for said elements.

Finally, in a sixth step, the machine is actuated so as to complete the item in a per se known manner.

In this way, the item is closed at its toe, or rather at the axial end at which knitting began.

In practice it has been found that the method according to the invention fully achieves the intended aim, since it allows to obtain items which are closed at one of their axial ends by means of the same machine that is used for their production. By virtue of the fact that closure is performed at a row of knitting which is subsequent to the first formed row of knitting, it is possible to achieve higher rigidity of the closure of the toe of the item.

The method thus conceived is susceptible of numerous modifications and variations, all of which are within the scope of the inventive concept; all the details may furthermore be replaced with other technically equivalent elements.

In practice, the materials used, as well as the dimensions, may be any according to requirements and to the state of the art.

The disclosures in Italian Patent Application No. MI199A001068 from which this application claims priority are incorporated herein by reference.

What is claimed is:

1. A method for producing knitted tubular items, which are closed at an axial end, comprising the steps of:

providing a single-cylinder circular machine provided with a half-dial which faces, in an upward region, a first half of a needle cylinder and has hooks which are movable in a radial direction with respect to an axis of the needle cylinder, such that each hook being arranged between two contiguous needles of said first half of the needle cylinder, and such that said half-dial being able to turn over about a diametrical axis of the needle cylinder so that said hooks face the needles of the second half of the needle cylinder;

moving said hooks in a radial direction with respect to the axis of the needle cylinder and engaging portions of loops of knitting formed by the needles of said first half of the needle cylinder;

turning over said half-dial and releasing said portions of loops of knitting to the needles of said second half of the needle cylinder after the half-dial has turned over;

arranging the loops of knitting formed by said needles of the first half of the needle cylinder, and belonging to a row of knitting that follows the one engaged by said hooks, above the needles of the second half of the needle cylinder; and raising the needles of said second half of the needle cylinder to knit so as pass the needles of said second half of the needle cylinder through the loops of said subsequent row of knitting and so as to knit new loops in, with the loops of said subsequent row of knitting during subsequent knitting of the item.

2. The method of claim 1, comprising:

actuating the needle cylinder with an alternating rotary motion about the axis thereof, with at least one forward motion and at least one return motion, and moving the needles of the first half of the needle cylinder and the hooks of the overlying half-dial so as to pass in front of a feed of the machine and extracting the hooks of the half-dial in order to form a support for the thread supplied at said feed and the needles being actuated in order to engage the thread so as to be alternated with inactive needles, and swapping the actuated needles with the inactive needles when the motion of the needle cylinder reverses;

subsequently retracting the hooks into the overturning half-dial, and retaining the engaged thread;

subsequently producing heel knitting with the needles of the first half of the needle cylinder by actuating the needle cylinder with an alternating rotary motion about the axis thereof;

subsequently over-turning the half-dial about said diametrical axis so that said hooks, which retained the thread, face the needles of the second half of the needle cylinder;

subsequently extracting the hooks from the half-dial in order to place loops that belong to said subsequent row of knitting above the needles of the second half of the needle cylinder, and actuating the needle cylinder with a continuous rotary motion about the axis thereof so that a row of knitting is formed by the needles of said first half of the needle cylinder as a continuation of the previously formed rows of knitting and so that the needles of said second half of the needle cylinder form a row of loops of knitting which are knitted in, with the loops of said subsequent row of knitting, released by said hooks after the needles of said second half of the needle cylinder have passed through the loops of said subsequent row of knitting;

subsequently actuating the machine so as to complete the item.

3. The method of claim 2, comprising forming the first row of knitting from the row of knitting retained by said hooks, and forming said subsequent row of knitting as the second row of knitting starting from the first row of knitting.

4. The method of claim 2, comprising forming the first row of knitting from the row of knitting retained by said hooks, and forming said subsequent row of knitting as the third row of knitting starting from the first row of knitting.

5. The method of claim 4, comprising forming said first row of knitting with an elastically extensible thread.

6. The method of claim 5, comprising forming said subsequent row of knitting with a substantially inextensible thread.

7. The method of claim 5, comprising forming said subsequent row of knitting with a thread which is less extensible than the thread used to form said first row of knitting.

8. The method of claim 4, comprising, during any of the forward and return motion of the needle cylinder, moving the first needle of the second half of the needle cylinder to pass in front of said feed and actuating the first needle of the second half of the needle cylinder so as to engage the thread, in order to allow the thread to be engaged by both of the end hooks of the half-dial.

9. The method of claim 8, comprising, during any of the forward and return motion of the needle cylinder, also moving the last needle of the second half of the needle cylinder to pass in front of said feed and actuating the last needle of the second half of the needle cylinder so as to engage the thread.

10. The method of claim 9, comprising:

providing said hooks with a laminar body in which an end thereof that is directed away from the axis of the needle cylinder has an uncinate portion;

providing a corresponding auxiliary hook arranged laterally adjacent to each one of said hooks and with a laminar body and an uncinate end which is orientated in the opposite direction with respect to the uncinate end portion of the end of said hook;

providing said hooks and said auxiliary hooks movable on command toward and away from the axis of the needle cylinder, and providing each hook and corresponding auxiliary hook elastically flexible toward each other during movement thereof toward the axis of the needle cylinder so as to provide closure of said uncinate end portion of the hook by way of the uncinate end of the auxiliary hook, and so as to move mutually apart upon movement thereof in the opposite direction in order to free the uncinate end potion of the hook;

forming a passage between said hook and the corresponding auxiliary hook, proximate to said uncinate ends thereof, for a needle of the needle cylinder which is arranged between two contiguous hooks;

knitting the needles of the second half of the needle cylinder in new loops of knitting, by passing through the passage formed between a hook and the corresponding auxiliary hook and between the loops of said subsequent row of knitting, which are arranged beforehand by said hooks above the needles of the second half of the needle cylinder.

11. The method of claim 9, wherein comprising:

providing said hooks with a laminar body in which an end thereof that is directed away from the axis of the needle cylinder has an uncinate portion;

providing a corresponding auxiliary hook arranged laterally adjacent to each one of said hooks and with a laminar body and an uncinate end which is orientated in the opposite direction with respect to the uncinate end portion of the end of said hook;

providing said hooks and said auxiliary hooks movable on command toward and away from the axis of the needle cylinder, and providing said auxiliary hook movable with respect to said hook in order to produce, with the uncinate end thereof, opening and closure of said uncinate end portion of the hook;

forming with the needles of the second half of the needle cylinder, new loops of knitting which are knitted in with the loops of knitting of said subsequent row by passing laterally outside a hook and the corresponding auxiliary hook, between the loops of said subsequent row of knitting, which are arranged beforehand by said hooks above the needles of the second half of the needle cylinder.

12. A single-cylinder circular knitting machine for forming tubular knitted items, which are closed at an axial end thereof, comprising:

a needle cylinder actuatable with a rotary motion about an axis thereof, said needle cylinder having a curved surface with a plurality of axial slots;

a plurality of needles, each of which is accommodated in a respective one of said axial slots;

a half-dial facing the needle cylinder in an upward region and having a plurality of radial slots, each of which is arranged between two axial slots of the needle cylinder;

a plurality of hooks, each having an end directed away from the axis of the needle cylinder which is uncinate;

a plurality of auxiliary hooks, each having an uncinate end which is directed away from the axis of the needle cylinder, and which lies opposite the uncinate end portion of said hook and is movable so as to open and close said uncinate end portion of said hook, and is movable so as to open and close said uncinate end portion of the hook;

said half-dial being adapted to turn over on command about a diametrical axis of the needle cylinder so that said hooks face, with the uncinate end portion thereof that is directed upward, the needles of a first half of the needle cylinder and face, with the uncinate end portion that is directed downward, the needles of the second half, of the needle cylinder, for retaining loops of knitting in said uncinate end portion, and wherein each one of said hooks has a beak which faces said uncinate end portion of the hook;

said beak, when sad half-dial faces the needles of said second half of the needle cylinder, being configured so as to be arranged below said uncinate end portion of the hook and being engageable with a loop of knitting which belongs to a subsequent row of knitting with respect to the loops of knitting engaged by said uncinate end portion of the hook.

13. A hook in a single-cylinder circular knitting machine for producing tubular knitted items, which are closed at an axial end thereof, said single-cylinder circular knitting machine comprising a half-dial with a radial slot in which said hook is slidingly arranged, said hook comprising: a laminar body which has, at an axial end thereof, an uncinate portion; and a beak which faces said uncinate portion and which engages a loop of knitting which belongs to a subsequent row of knitting with respect to the loop of knitting engaged by said uncinate portion.

* * * * *